US005784678A

United States Patent [19]

Matsuura et al.

[11] Patent Number: 5,784,678

[45] Date of Patent: Jul. 21, 1998

[54] BELT-TYPE FIXING UNIT HAVING OBTUSELY ANGLED ENTRY

[75] Inventors: Masahiko Matsuura, Suita; Satoshi Deishi, Ibaraki; Tomoo Izumi, Osaka, all of Japan

[73] Assignee: Minolta Co., Ltd., Osaka, Japan

[21] Appl. No.: 800,731

[22] Filed: Feb. 13, 1997

[30] Foreign Application Priority Data

Feb. 14, 1996 [JP] Japan ..... 8-026641

[51] Int. Cl.[6] ..... G03G 15/20

[52] U.S. Cl. ..... 399/329

[58] Field of Search ..... 399/329, 320, 399/328; 219/216

[56] References Cited

U.S. PATENT DOCUMENTS

| | | | |
|---|---|---|---|
| 5,053,829 | 10/1991 | Field et al. | 399/329 |
| 5,115,278 | 5/1992 | Maruta et al. | 219/216 |
| 5,262,834 | 11/1993 | Kusaka et al. | 399/329 |
| 5,309,210 | 5/1994 | Yamamoto et al. | 399/329 |
| 5,386,281 | 1/1995 | Mitani et al. | 399/329 |
| 5,499,087 | 3/1996 | Hiraoka et al. | 399/329 |

FOREIGN PATENT DOCUMENTS

| | | |
|---|---|---|
| 60-151677 | 8/1985 | Japan . |
| 4-324476 | 11/1992 | Japan . |

*Primary Examiner*—Robert Beatty
*Attorney, Agent, or Firm*—McDermott, Will & Emery

[57] ABSTRACT

An improved belt-type fixing unit in which an unfixed developer on a sheet is not disordered by a disturbed air flow when the sheet enters a contact section of a fixing belt and a pressure roller which comes in pressure contact with it, i.e., a fixing section. In the belt-type fixing unit, a space just before the entry of the sheet into the fixing section is obtusely formed so as to secure a sufficient space for the disturbed air flow to escape.

10 Claims, 3 Drawing Sheets

<PRIOR ART>

<PRIOR ART>

BELT-TYPE FIXING UNIT HAVING OBTUSELY ANGLED ENTRY

BACKGROUND OF THE INVENTION

1. Field of the Invention

The present invention relates to a belt-type fixing unit for use in image forming apparatuses such as copying machines, printers and facsimiles, and relates to a belt-type fixing unit which heats an unfixed developer to fix the same onto a sheet such as paper.

2. Description of the Related Art

As a belt-type fixing unit, there has been proposed one as shown in FIG. 3. This fixing unit 100 is provided with an endless-type fixing belt 102. Inside the fixing belt 102 are provided two rollers 104 and 106 for supporting it. Outside the fixing belt 102 is provided a pressure roller 110 having a heater 108, and this is put in contact with an upper belt portion of the fixing belt 102. Further, in the fixing unit 100, a pressing roller 112 is provided inside the fixing belt 102 in order to stabilize the contact of the pressure roller 110 with the fixing belt 102, by which the fixing belt 102 is pressed against the pressure roller 110. In this fixing unit 100, the rollers rotate in the respective directions of the arrows and the fixing belt 102 rotatively moves in the direction of the arrow by a motor (not shown). Further, heat of the heater 108 is transmitted to the fixing belt 102 via the pressure roller 110. Additionally, a sheet 116 having an unfixed developer 114 proceeds to a contact section of the fixing belt 102 and the pressure roller 110, i.e., a nip section 118, where the sheet is heated by the fixing belt 102 and the pressure roller 110, so that the developer 114 is fused to be fixed onto the sheet 116.

As another belt-type fixing unit, there is one shown in FIG. 4. In this fixing unit 200, an endless-type fixing belt 202 is supported by a heating roller 204 and a driving roller 206 both provided inside it, and a pressure roller 208 is put in contact with a lower belt portion of the fixing belt 202. Also in this fixing unit 200, the rollers rotate in the respective directions of the arrows and the fixing belt 202 rotatively moves in the direction of the arrow by a motor (not shown) similar to the aforementioned fixing unit 100. Further, the fixing belt 202 is heated by the heating roller 204. Therefore, when a sheet 212 having a developer 210 enters a contact section of the fixing belt 202 and the pressure roller 208, i.e., a nip section 214, the developer 210 is heated here to be fused and fixed onto the sheet 212.

However, in these fixing units 100 and 200, spaces 120 and 216 just before the nip sections 118 and 214 are formed acutely, i.e., into a wedge shape by the outer peripheral surfaces of the fixing belts 102 and 202 and the pressure rollers 110 and 208. Therefore, when an air flow generated around the sheets 116 and 212 consequent upon the movement of them and an air flow generated around the fixing belts 102 and 202 consequent upon the movement of them collide with each other, the air flows resulting from collision have no space to escape, and therefore, a disturbed air flow is generated in the spaces 120 and 216. Further, there has been the problem that the unfixed developer on the sheet is disordered or scattered by the disturbed air flow.

SUMMARY OF THE INVENTION

It is an object of the present invention to provide an improved belt-type fixing unit which solves the aforementioned problems.

It is a further object of the present invention to provide a belt-type fixing unit in which an unfixed image on a sheet is neither disordered nor scattered by a disturbed air flow when the sheet which carries thereon the unfixed image enters a contact section of a fixing belt and a pressure roller.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
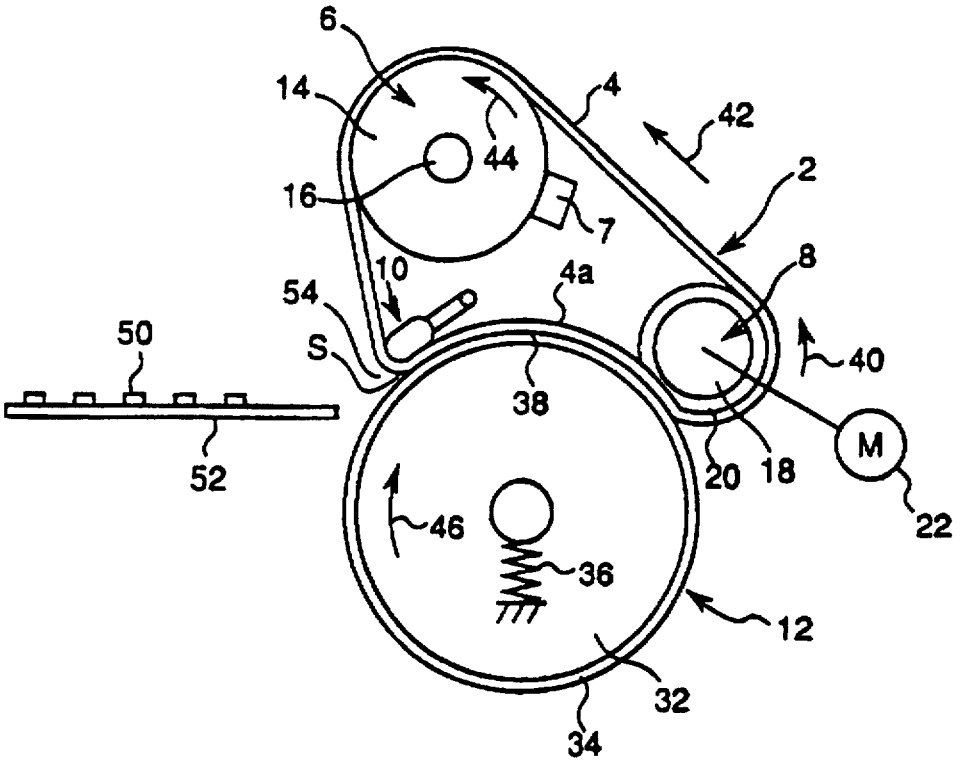
FIG. 1 is a front view of a fixing unit according to the present invention.

A preferred embodiment of the present invention will be described below with reference to the accompanying drawings. FIG. 1 shows a belt-type fixing unit 2 according to the present invention. In the fixing unit 2, an endless-type fixing belt 4 is provided with a protection layer formed on the outer peripheral surface of a thin flexible base layer made of a metal or a heat-resistant resin. Aluminum or stainless steel is preferably used as the above-mentioned metal, while polyimide, polyamide or polyamide-imide is preferably used as the heat-resistant resin. Fluoro-rubber, silicone rubber or teflon is preferably used as the material of the protection layer.

The aforementioned fixing belt 4 is internally supported by a heating roller 6, a driving roller 8 and a pressing member 10, and a pressure roller 12 is put in contact with the outer peripheral surface of a belt portion **4*a* that extends from the driving roller 8 to the pressing member 10**.

The heating roller 6 is provided with a cylindrical core metal 14 made of a metal such as aluminum or iron having an excellent heat conductivity and a heater 16 housed inside the core metal 14, and it is pivotally supported to a frame (not shown) of the fixing unit. Further, a temperature detecting device 7 is put in contact with the outer peripheral portion of the heating roller 6 so as to detect an outer peripheral surface temperature of the heating roller 6. The driving roller 8 has a core metal 18 made of a metal such as aluminum or iron and a coating layer 20 which is made of an elastic material such as silicone rubber having a high coefficient of friction and covers the outer peripheral portion of the core metal 18 while being pivotally supported to the frame of the fixing unit in parallel with the heating roller 6 and connected to a driving motor 22. The pressing member 10 is constructed of a shaft 24 arranged in parallel with the heating roller 6, a plate member 26 supported pivotally to the shaft 24 and an elastic member 28 which covers a free end portion of the plate member 26 as illustrated in detail in FIG. 2 while being urged in the direction of an arrow 30 by an urging means such as a spring (not shown), thereby pressing the fixing belt 4 against the pressure roller 12. By virtue of the pressing member 10, a belt portion **4*b* extending from the heating roller 6 to the pressing member 10 is made linear. The pressure roller 12 is constructed of a core metal 32 made of a metal such as aluminum or iron and a coating layer 34 which is made of silicone rubber having excellent mold-releasing properties and elasticity and covers the outer peripheral portion of the core metal 32, as supported pivotally to the frame of the fixing unit, pressed against the driving roller 8 and the pressing member 10 via the belt 4 by an urging member such as a spring 36 and put in contact with the belt portion 4a that extends between them. The contact section of the pressure roller 12 and the belt portion 4a will be referred to as a "nip section 38**" hereinafter.

Figure 2:
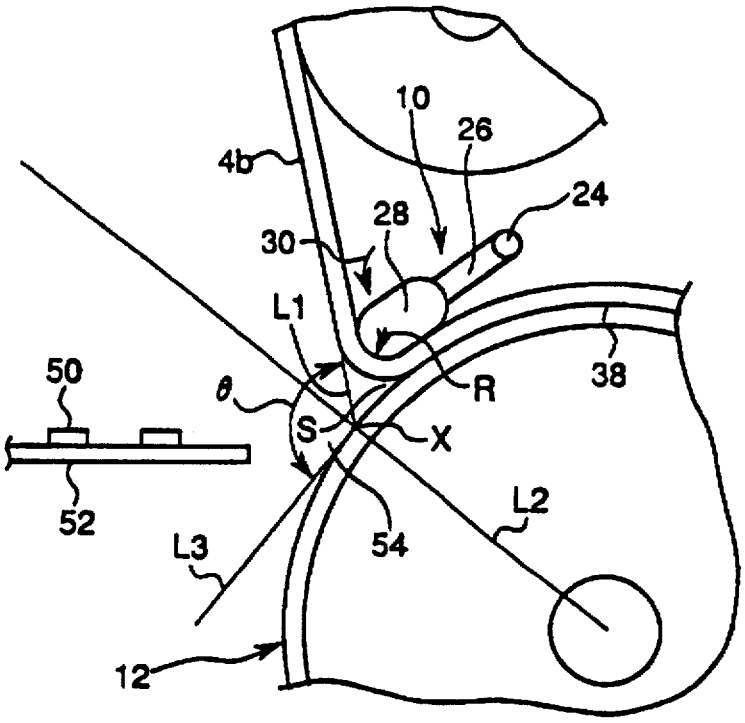
FIG. 2 is an enlarged view of a part of the fixing unit shown in FIG. 1.
Figure 3:
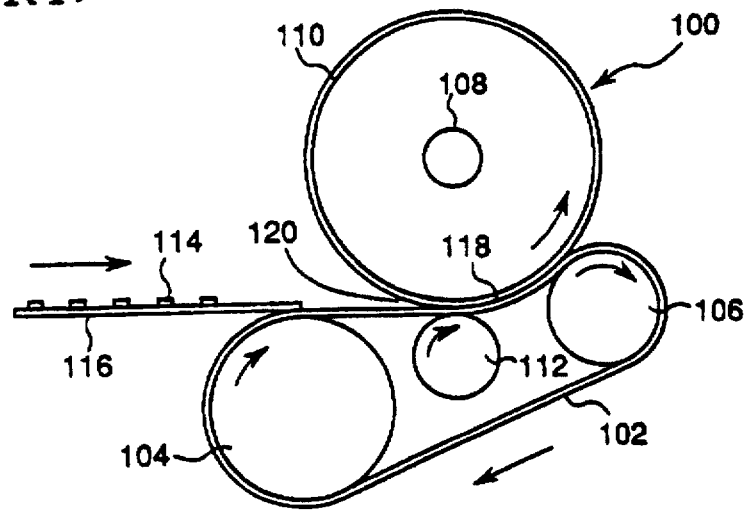
FIG. 3 is a front view of a first prior art fixing unit.
Figure 4:
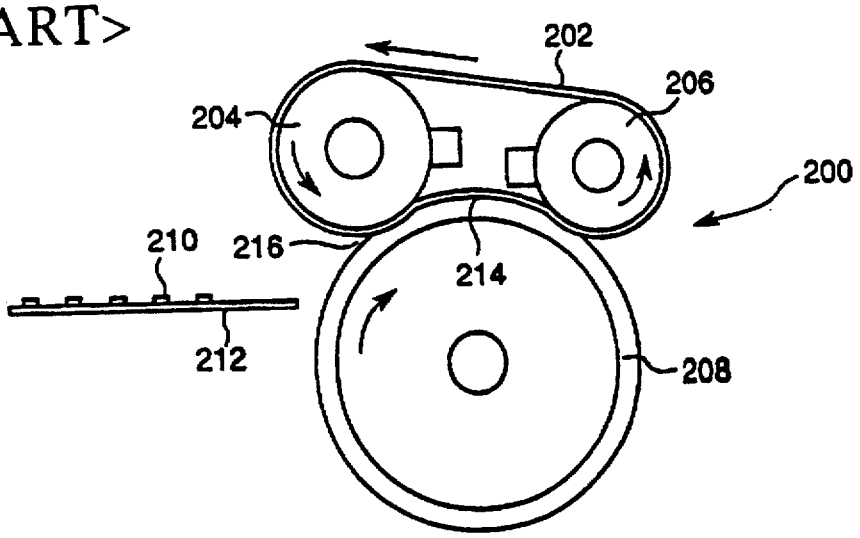
FIG. 4 is a front view of a second prior art fixing unit.

In the aforementioned fixing unit 2, the heating roller 6 and the pressing member 10 are set in a specified positional relationship. Referring to FIG. 2 for explanation, if it is assumed that an intersection of an extension line L1 of the linear belt portion 4b that extends from the heating roller 6 toward the pressing member 10 and the outer peripheral surface of the pressure roller 12 is X, and a normal line of the pressure roller 12 passing through the intersection X is L2 and a tangential line of the pressure roller 12 passing through the intersection X is L3, the heating roller 6 and the pressing member 10 are arranged so that a crossing angle θ between the tangential line L3 and the belt portion 4b formed externally of the belt portion 4b and the pressure roller 12 is an obtuse angle (not smaller than 90° and not greater than 180°). Further, the portion of the pressing member 10 put in contact with the fixing belt 4 is formed into an arc shape, and its curvature is set so that its radius R is not greater than 3 mm. With this arrangement, a wedge-shaped space S formed just before the nip section 38 is very small.

In the thus constructed fixing unit 2, when the driving roller 8 rotates in the direction of an arrow 40 based on the drive of the motor 22, the fixing belt 4 rotatively moves in the direction of an arrow 42. By this operation, the heating roller 6 rotates in the direction of an arrow 44, and the pressure roller 12 rotates in the direction of an arrow 46. It is acceptable to operatively connect the pressure roller 12 to an independent motor and thereby rotate the roller in synchronization with the moving speed of the fixing belt 4. Further, heat of the heater 16 is transmitted to the fixing belt 4 via the heating roller 6. It is to be noted that the electrification of the heater 16 is controlled based on the surface temperature of the heating roller 6 detected by the temperature detecting device 7.

When a sheet 52 having an unfixed developer 50 enters the nip section 38 in the above state, the developer 50 put in contact with the fixing belt 4 is fused to be fixed onto the sheet 52. Then, the portion of the fixing belt 4 in which temperature has lowered consequent upon the contact with the sheet 52 is heated again by the heating roller 6.

Furthermore, an air flow is generated around the sheet 52 in the space just before the nip section 38 with the movement of the sheet 52. An air flow is likewise generated around the fixing belt 4 with the movement of the belt. These air flows collide with each other in a space 54 just before the entry of the sheet 52 into the nip section 38. It should be remembered that the space just before the nip section has been acutely formed in the aforementioned prior art fixing units, causing the problem that the unfixed developer is disturbed by the air flows resulting from collision. In contrast to this, according to the fixing unit 2, the space 54 is obtusely formed so as to secure a sufficient space for the air flow resulting from collision to escape. With this arrangement, the flow speed of the collision air flow is slow, and the unfixed developer enters the nip section 38 without being disordered. Furthermore, the portion of the pressing member 10 put in contact with the fixing belt is made to have a radius of not greater than 3 mm, and therefore, the space S just before the nip section 38 is very small, and the aforementioned air flow does not stagnate. Therefore, the disorder of the unfixed developer is further reduced.

The disorder of an image was examined with the crossing angle θ between the linear belt portion 4b and the tangential line L3 set at 70°, 85°, 90°, 97° and 105°, with the heating roller 6 moved to a plurality of positions. The image used in the experiment was such an image that lines (ruled lines) extending in the direction perpendicular to the direction of the movement of the sheet are drawn at regular intervals. The moving speed of the fixing belt 4 was set to 500 mm/sec., and the fixing pressure was set to 15 kg. For the fixing belt, one having a silicone rubber coating of about 50 μm formed on its base layer of about 50 μm was used. As a result, a plurality of noises clearly appeared after each line on the image when θ=70°. When θ=85° or 90°, similar noises appeared on the image though they are less significant than when θ=70°. However, no noise was observed and clear lines were reproduced when θ=97° or 105°.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A belt-type fixing unit comprising:

an endless-type belt;

first and second support members which internally rotatably support said belt;

a rotatable roller which externally comes in pressure contact with said belt;

a heat member which heats said belt;

a drive unit which rotatively drives said belt in a prescribed direction; and a third support member which internally supports said belt and cooperates with said second support member in forming a nip section between said rotatable roller and said belt so that said belt forms a linear portion on the upstream side of said nip section in the direction in which said belt moves, wherein the linear portion of said belt and a tangential line of said rotatable roller passing through an intersection of a line extended from said linear portion and an outer peripheral surface of said rotatable roller form an obtuse angle outside said belt.

2. A belt-type fixing unit as claimed in claim 1, wherein said linear portion of the belt is formed between said first support member and said third support member.

3. A belt-type fixing unit as claimed in claim 1, wherein said first and second support members are rollers.

4. A belt-type fixing unit as claimed in claim 1, wherein said heat member is a heat roller in which a heater is housed.

5. A belt-type fixing unit as claimed in claim 4, wherein said heat roller also works as said first support member.

6. A belt-type fixing unit as claimed in claim 1, wherein the portion of the third support member put in contact with said belt in a portion just before said nip section in the direction in which said belt moves is formed into an arc shape having a radius of not greater than 3 mm.

7. A belt-type fixing unit comprising:

an endless-type belt;

first and second support members which internally rotatably support said belt;

a rotatable roller which externally comes in pressure contact with said belt to form a nip section between said rotatable roller and said belt;

a heat member which heats said belt;

a drive unit which rotatively drives said belt in a prescribed direction; and a third support member which internally supports said belt so that said belt forms a linear portion on the upstream side of said nip section in the direction in which said belt moves, wherein the linear portion of said belt and a tangential line of said rotatable roller passing through an intersection of a line extended from said linear portion and an outer peripheral surface of said rotatable roller form an obtuse angle outside said belt, and wherein the portion of the third support member put in contact with said belt in a portion just before said nip section in the direction in which said belt moves is formed into an arc shape having a radius of not greater than 3 mm.

8. A belt-type fixing unit comprising:

an endless-type belt;

first and second support members which internally rotatably support said belt;

a rotatable roller which externally comes in pressure contact with said belt to form a nip section between said rotatable roller and said belt;

a heat member which heats said belt;

a drive unit which rotatively drives said belt in a prescribed direction; and a third support member which internally supports said belt so that said belt forms a linear portion on the upstream side of said nip section in the direction in which said belt moves, wherein the linear portion of said belt and a tangential line of said rotatable roller passing through an intersection of a line extended from said linear portion and an outer peripheral surface of said rotatable roller from an obtuse angle outside said belt, and wherein said third support member includes a shaft arranged perpendicular to the direction in which said belt moves, a plate member supported rotatively to said shaft and an elastic member that covers a free end portion of said plate member and comes in contact with said belt.

9. A method of fixing an unfixed developer onto a sheet by means of a belt-type fixing unit having an endless-type belt that is internally supported by first and second support members, a pressure roller that externally comes in pressure contact with said belt to form a nip section between said pressure roller and said belt, a heat member that heats said belt and a drive unit that rotatively drives said belt in a prescribed direction, comprising the following steps of:

1) supporting said belt internally by a third support member which cooperates with said second support member in forming a nip section between said pressure roller and said belt, so that said belt forms a linear portion on the upstream side of said nip section in the direction in which said belt moves, wherein the linear portion of said belt and a tangential line of said pressure roller passing through an intersection of a line extended from said linear portion and an outer peripheral surface of said pressure roller form an obtuse angle outside said belt; and 2) sending said sheet having said unfixed developer into said nip section.

10. A belt-type fixing unit comprising:

an endless-type belt;

first and second support members which internally rotatably support said belt;

a rotatable roller which comes in contact with said second support member via said belt to form a nip section between said rotatable roller and said belt, the pressure generated by said support member and said rotatable roller in the nip section being generally constant;

a heat member which heats said belt; and a drive unit which rotatively drives said belt in a prescribed direction, wherein said belt forms a linear portion on the upstream side of said nip section in the direction in which said belt moves, and wherein the linear portion of said belt and a tangential line of said rotatable roller passing through an intersection of a line extended from said linear portion and an outer peripheral surface of said rotatable roller form an obtuse angle outside said belt.

* * * * *

UNITED STATES PATENT AND TRADEMARK OFFICE

CERTIFICATE OF CORRECTION

PATENT NO. : 5,784,678

DATED : July 21, 1998

INVENTOR(S) : MATSUURA et al.

It is certified that error appears in the above-identified patent and that said Letters Patent is hereby corrected as shown below:

Cover page, under "Inventors": Item [75]

Delete cities for Inventors and insert --all of Osaka, Japan--

Signed and Sealed this

Thirteenth Day of October 1998

*Attest:*

*Attesting Officer*

Bruce Lehman

BRUCE LEHMAN

*Commissioner of Patents and Trademarks*